US006158350A

United States Patent [19]

Pulcini

[11] Patent Number: 6,158,350

[45] Date of Patent: Dec. 12, 2000

[54] LIGHTWEIGHT ENHANCED VELOCITY BULLET

[76] Inventor: Valentino Pulcini, 2017 Carlton Rd., Whitehall, N.Y. 12887

[21] Appl. No.: 09/322,005

[22] Filed: May 28, 1999

[51] Int. Cl.[7] ..... F42B 10/34; F42B 12/74

[52] U.S. Cl. ..... 102/516; 102/509; 102/517; 102/501; 420/557; 420/560

[58] Field of Search ..... 102/501, 507–510, 102/514–517; 420/557, 560

[56] References Cited

U.S. PATENT DOCUMENTS

| | | | |
|---|---|---|---|
| 1,059,213 | 4/1913 | Ross | 102/509 |
| 1,062,919 | 5/1913 | Johnson | 102/509 |
| 1,512,026 | 10/1924 | Holden et al. | 102/509 |
| 2,045,964 | 6/1936 | Rinkel | 102/509 |
| 5,279,787 | 1/1994 | Oltrogge | 419/38 |
| 5,500,183 | 3/1996 | Noordegraaf et al. | 102/501 |
| 5,763,819 | 6/1998 | Huffman | 102/510 |
| 6,016,754 | 1/2000 | Enlow et al. | 102/516 |

*Primary Examiner*—Harold J. Tudor
*Attorney, Agent, or Firm*—John J. Welch, Jr., Esq.

[57] ABSTRACT

The instant invention is a lightweight enhanced velocity bullet consisting of a hollow cylindrically shaped metal jacket component made of brass, the body of which is filled nearly to capacity with a malleable tin-copper-silver alloy material and with the body having a flattened posterior end and with there being a second end anterior to the body which said second end is hollow within, devoid of any alloy material and tapering symmetrically to a blunt point.

1 Claim, 1 Drawing Sheet

LIGHTWEIGHT ENHANCED VELOCITY BULLET

CROSS REFERENCES TO PRIOR OR PARENT APPLICATIONS

There are no prior or parent applications to which the instant invention relates.

FEDERALLY SPONSORED RESEARCH AND DEVELOPMENT

There is no federally sponsored research and development with respect to which the instant invention is, in any involved.

BACKGROUND OF THE INVENTION

1. Field of the Invention

The instant invention relates to that field of devices made up of various types of ammunition for use in connection with the use of guns such as rifles and pistols.

2. Prior Art

Your inventor is aware of no prior art that in any way anticipates the instant invention.

SUMMARY OF THE INVENTION

1. A Brief Description of the Invention

The instant invention is a lightweight enhanced velocity bullet. It consists of a hollow cylindrically shaped jacket component made of a brass material which is filled nearly to capacity within the body thereof by a core made up of a malleable tin-copper-silver alloy material. The body of the jacket component is characterized by the presence of a flattened posterior end, and, there is moreover, a hollow second end of the jacket anterior to the body thereof, the second end being devoid of the presence of any core material, being completely closed and tapering symmetrically to a blunt point.

2. Objects of the Invention

Hunters seeking out so-called varmints such as coyotes and destructive woodchucks have perennially been in need of resort to the use of superbly dependable ammunition. Such ammunition as would be so desired by them for such purposes is ammunition that can fly as straight as feasibly possible with minimal wind effect serving to influence the path of travel of such ammunition. Moreover, maximal range and force of impact are yet further desirable features of such ammunition, since, oftentimes such predatory varmints are observed only at significant distances from such hunters. Likewise, reduced recoil and noise upon firing are also desirable. Finally, an abrogation of lead as an ingredient endemic to ammunition is unquestionably a desirable objective from an ecological vantage point.

The instant invention responds magnificently to the achievement, at once, of all of those desired objectives. The instant invention is a lightweight bullet uniquely made up of a brass jacket encompassing a core consisting of a malleable tin-copper-silver alloy material rather than a typically lead core contained within a copper jacket and is accordingly capable of achieving an extremely high velocity as compared to such other types of bullets currently in vogue. It is also lead free. Of significances as well is that it can be utilized in either large or small cartridges and is, by virtue of the material integrity of its core component easily manufactured in a dye without fear that it, given its lightweight character, would be crushed in the process.

A DESCRIPTION OF THE DRAWINGS

Figure 1:
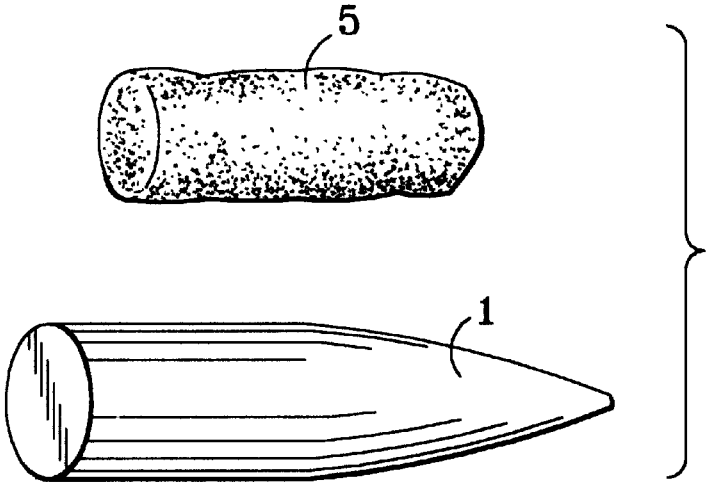

1. FIG. 1 is a perspective view of the components of the instant invention, namely a jacket component serving to encase a core component which said core component is shown in apposition to the jacket component.

Figure 2:
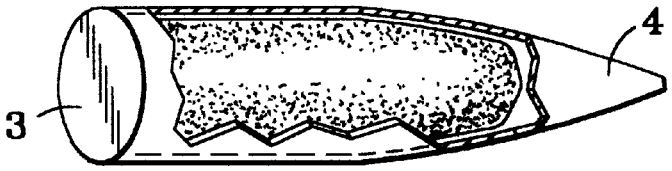

2. FIG. 2 is a perspective broken view of the instant invention.

Figure 3:
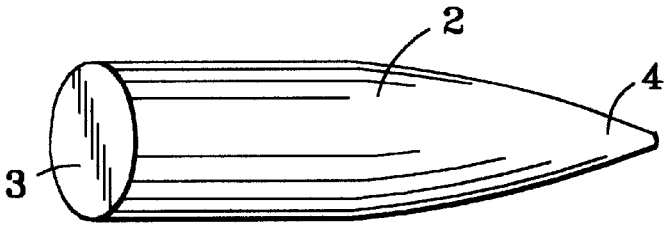

3. FIG. 3 is a perspective view of the instant invention.

A DESCRIPTION OF THE PREFERRED EMBODIMENTS

The instant invention is a lightweight enhanced velocity bullet. It consists of a jacket component 1 seen in FIGS. 1, 2 and 3, the body 2 of which is cylindrically shaped. The body 2 is characterized by the presence of a flattened posterior end 3 seen in FIGS. 1 and 3. The jacket component 1 is hollow throughout including a second end 4 thereof which is anterior to and coextensive with body 2. Second end 4 is completely closed and tapers symmetrically to a blunt point. A core component 5 is to be found within body 2 and nearly completely fills body 2. Core material 5 which is a malleable tin-copper-silver alloy material is depicted in FIG. 1. The percentage-wise composition of the core 5 is typically 95.6% tin, 4% copper and 0.4% silver, although other similar percentage-wise compositions thereof in respect to these three elements would prove suitable in such regards as well. As was earlier noted, a need to fill body 2 nearly full with a core component 5 is a result of inter alia a need to prevent a crush of a jacket component 1 during manufacture of the bullet. Moreover, such filling serves to promote aerodynamic stability. No core material 5 is to be found within hollow second end.

Virtually all bullets to be found within any cartridge within which there is powder behind the bullet to propel it are made up of a copper jacket and a lead core; although, occasionally, a brass jacket and a lead core constitutes the makeup of same such bullets. On account of the makeup of such bullets especially in view of the lead cores thereof, such bullets are invariably relatively heavy in comparison to the instant invention. Such bullets weight at least 35 grains, and, more often, at least 40 grains as contrasted with the instant invention that weighs only 25 grains. Whereas, all bullets including the instant invention are 0.224 calibre missles, it is impossible to effectively ever manufacture a 25 grain bullet that would have a lead core. This is because in order to manufacture a bullet and not crush its jacket component in the process of doing so, the body of the jacket component must be essentially completely filled with core material. But, lead is too heavy a material to ever essentially fill the body of a jacket so as to ever permit one to end up with a 0.224 calibre bullet weighing less than, for example, 35 grains.

There are, at once, many clear advantages to a 25 grain bullet as contrasted with a 35 grain or a 40 grain bullet. To begin with, as noted above, the elimination of lead as a core material is unquestionably, environmentally appropriate. Also, given the smaller amount of propellant required for achievement of a given range of travels, the amount of noise and recoil experienced upon firing is not insubstantially reduced as well. The instant invention is amenable to placement within not only medium sized cartridges and indeed larger sized cartridges as well but more significantly into smaller sized cartridges such as a 22 Hornet or 218 Bee variant. Hence, the instant invention can be fired from small guns or even pistols as well as from larger type guns such as higher capacity rifles. The lightweight character of the instant invention serves to greatly enhance its velocity in flight and concomitantly its trueness of flight. The impact it delivers to a target when struck as it travels is correspondingly increased significantly as well. The unique lightweight character of the instant invention given the light weight of core material 5, to wit, 9 grains as opposed to the weight of a corresponding volume of lead, to wit, of the order of, for example, 21 grains, enables one to successfully bring down predators such as coyotes and the like at much greater ranges than would be possible with resort to the utilization of a heavier bullet such as one containing a lead core.

The lightweight character of the instant invention serves to enhance its velocity whereas the maximum amount of propellant powder that can be utilized safely within a given size cartridge to give impetus to the invention upon firing can be significantly increased due to the lightweight character of the invention given that maintained cartridge structural integrity during firing is dependent upon both the number of grains of powder utilized to propel a bullet contained therein upon firing as well as the weight of the bullet itself. Maintained continued cartridge structural integrity is very important not only from a performance vantage point but also from a safety vantage point as well. Too much powder with too heavy a bullet that serves to blow apart a cartridge could also destroy a weapon and potentially seriously maim or injure a user of the weapon containing the cartridge holding the powder and bullet. Test results were obtained utilizing reasonably calculated safe maximal loads of varied propellant powders within 22 Hornet cartridges and within 218 Bee cartridges. Safe maximal load levels of powder vary according to the particular burn rates of each species of powder. The faster the burn rate, the lower the safe maximal load level would be. For example: the instant invention weighing 25 grains within a 22 Hornet cartridge was found to be safely propellable by a maximum load of 13.8 grains of Winchester Powder and upon firing was found to achieve a measured velocity of 3,311 feet per second. With Hercules Alliant powder with such a maximum load thereby being 12 grains, the measured velocity was 3,562 feet per second. These results are sharply contrastable with the measured velocity of only 2,664 feet per second achieved by a conventional 40 grain bullet within such a cartridge under a maximum load of 12 grains of Winchester Powder or a measured velocity of only 2,604 feet per second from therein for such a bullet under such a maximum load of 9.5 grains of Hercules Alliant powder a safe maximal load thereof for a 25 grain bullet in a 218 Bee cartridge served to propel the instant invention at a measured velocity of 3,801 feet per second. 11.5 grains of Hercules powder, a safe maximal load thereof for a 45 grain bullet in such a cartridge, resulted on the other hand in a measured velocity of only 2,800 feet per second. The sharp contrasts in the velocities of each bullet within each cartridge are clearly evident.

In view of the foregoing, respectfully submitted, the instant invention is not only new, useful and unquestionably unique, it is likewise indeed truly revolutionary in the framework of the art of ammunition products.

What is claimed is:

1. A lightweight enhanced velocity bullet, comprising:

a. a hollow cylindrically shaped jacket component;

b. said jacket component being made of brass material;

c. a body portion of said jacket components being filled nearly to capacity with a core component;

d. said core component being made of a malleable alloy material consisting of 95.6% tin, 4% copper and 0.4% silver;

e. said body of said jacket component having a flattened posterior end;

f. said jacket component having a second end coextensive with and anterior to said body thereof, and;

g. said second end being hollow within, symmetrically tapered to a blunt point and devoid of the presence of any of said malleable alloy material.

* * * * *